US010919075B2

(12) United States Patent
Mosca et al.

(10) Patent No.: US 10,919,075 B2
(45) Date of Patent: Feb. 16, 2021

(54) BROADBAND UNDERWATER ACOUSTIC TRANSCEIVER DEVICE

(71) Applicant: IXBLUE, Saint-Germain-en-Laye (FR)

(72) Inventors: Frédéric Mosca, Chateauneuf-le-Rouge (FR); Raphaël Eymard, Le Puy Sainte Reparade (FR); Guillaume Matte, La Ciotat (FR)

(73) Assignee: IXBLUE, Saint-Germain-en-Laye (FR)

( * ) Notice: Subject to any disclaimer, the term of this patent is extended or adjusted under 35 U.S.C. 154(b) by 374 days.

(21) Appl. No.: 15/767,035

(22) PCT Filed: Oct. 5, 2016

(86) PCT No.: PCT/FR2016/052559
§ 371 (c)(1),
(2) Date: Apr. 9, 2018

(87) PCT Pub. No.: WO2017/060620
PCT Pub. Date: Apr. 13, 2017

(65) Prior Publication Data

US 2019/0060954 A1 Feb. 28, 2019

(30) Foreign Application Priority Data

Oct. 9, 2015 (FR) ..... 1559619

(51) Int. Cl.
*B06B 1/00* (2006.01)
*B06B 1/06* (2006.01)
*G10K 15/04* (2006.01)

(52) U.S. Cl.
CPC ..... *B06B 1/0618* (2013.01); *B06B 1/0633* (2013.01); *G10K 15/04* (2013.01)

(58) Field of Classification Search
USPC ..... 367/153
See application file for complete search history.

(56) References Cited

U.S. PATENT DOCUMENTS

| | | | |
|---|---|---|---|
| 4,373,143 | A | 2/1983 | Lindberg |
| 5,515,342 | A | 5/1996 | Stearns et al. |
| 5,579,287 | A | 11/1996 | Boucher et al. |

(Continued)

FOREIGN PATENT DOCUMENTS

| | | |
|---|---|---|
| EP | 0 413 633 A1 | 2/1991 |
| JP | 2003-174695 A | 6/2003 |

OTHER PUBLICATIONS

International Search Report, dated Jan. 2, 2017, from corresponding PCT/FR2016/052559 application.

*Primary Examiner* — James R Hulka
(74) *Attorney, Agent, or Firm* — Nixon & Vanderhye

(57) ABSTRACT

Disclosed is a broadband underwater acoustic transceiver device. The device can be used in particular for positioning, detection, range finding or underwater acoustic communication. The device coaxially combines, within a transceiver device, a Tonpilz transducer and a FFR transducer, the FFR being arranged in front of the transmission face/horn of the Tonpilz transducer. In such a configuration, the Tonpilz horn also acts as reflective tape for the FFR transducer, forming a common tape-horn element. Furthermore, an annular baffle surrounding the Tonpilz pillar creates a Helmholtz cavity for broadening the emission band towards the low frequencies.

11 Claims, 1 Drawing Sheet

(56) References Cited

U.S. PATENT DOCUMENTS

| | | | | |
|---|---|---|---|---|
| 6,690,621 | B2 | 2/2004 | Porzio | |
| 6,798,122 | B1 * | 9/2004 | Howarth | G10K 9/121 310/337 |
| 8,027,224 | B2 | 9/2011 | Brown | |
| 2003/0235115 | A1 * | 12/2003 | Porzio | B06B 1/0614 367/158 |
| 2011/0110197 | A1 * | 5/2011 | Brown | B06B 1/0637 367/155 |
| 2017/0301332 | A1 * | 10/2017 | Lagier | G10K 11/008 |

* cited by examiner

BROADBAND UNDERWATER ACOUSTIC TRANSCEIVER DEVICE

TECHNICAL FIELD TO WHICH THE INVENTION RELATES

The present invention relates to a broadband underwater acoustic transceiver device. This device finds applications in particular for positioning, detection, range finding or underwater acoustic communication.

TECHNOLOGICAL BACK-GROUND

The underwater acoustic transducers are known and used for long. There exist several types thereof, which may implement magnetostrictive, electrostrictive or piezoelectric materials. Among the knows types of transducers, the two following ones can be mentioned:

- the Tonpilz, which is a stack composed of a rear countermass, electroactive, typically piezoelectric, elements and a front horn. The electroactive elements are taken in sandwich between the rear countermass and the front horn and this unit is generally held by a central prestressing rod extended between the rear countermass and the horn. A Tonpilz may be either resinated or, more generally, inserted into a casing filled with a fluid whose acoustic properties are adapted to the searched operation mode: for example, castor oil for the acoustic transparency or air for the baffling.
- the FFR ("Free Flooded Ring") transducer, which is an electroactive, typically piezoelectric, ring inserted into a fluid that may be either sea water if the ring is previously resinated, or castor oil, for example, if the ring is inserted into a tight hood. In order to obtain hemispherical directivities, a "plug", generally a metal disc, is installed on the rear of the ring, playing the role of an acoustic reflector.

The performance increase of a great number of underwater acoustic devices requires the use of acoustic signals utilizing a broad frequency band.

The width of the frequency band utilizable by an underwater acoustic transducer is generally proportional to the central frequency of this band. The transducers of the prior art implemented for the aimed applications generally cover one octave, i.e. ⅔ of the central frequency.

As a function of the searched ranges, the frequency bands utilized are different. Indeed, for a same distance of propagation, the higher acoustic frequencies are more absorbed by the medium, herein the Ocean, than the lower frequencies.

Hence, as a function of the needs, it may be useful to have a transceiver device capable of utilizing at least two distinct bands, of one octave each for example. The band covering the low frequencies (of central frequency $F_{LF}$) for the applications aiming at the long range, but of more reduced band widths (typically: ⅔ $F_{LF}$), and the band covering the high frequencies (of central frequency $F_{HF}$), aiming at shorter ranges but of wider band widths (⅔ $F_{HF}$).

Finally, the acoustic transceiver devices consisted of electroactive elements generally require for their application an angular aperture that is at least hemispherical.

In order to increase the utilizable frequency band of the underwater acoustic transceiver devices, it has been proposed to modify the structure of the transducers or, for a better result, to associate together several transducers having different structures and/or dynamic characteristics, in particular different utilizable frequency bands.

For example, in the documents EP 0413633 A1 "Emetteur large-bande sous-marin" by Safare-Crouzet or U.S. Pat. No. 8,027,224 "Broadband Underwater Acoustic Transducer" by Brown et al., it is proposed to cover several sub-bands by implementing spheres and/or rings of the FFR ("Free Flooded Ring") type, associated with each other. However, such a solution poses the difficulty of the radiation masking in the axis of alignment of the associated transducers.

Other modes of bandwidth broadening are also known from the documents U.S. Pat. No. 4,373,143 "Parametric Dual Mode Transducer", U.S. Pat. No. 6,690,621 "Active Housing Broadband Tonpilz Transducer" and U.S. Pat. No. 5,579,287 "Process and transducer for emitting wide band and low frequency acoustic waves in unlimited immersion depths".

OBJECT OF THE INVENTION

Contrary to those solutions associating transducers, the present invention proposes a combination of transducers of different types, at least one element of the device being common to the operation of the combined transducers. Hence, the solution proposed by the present invention consists in freeing from the masking effects by using a functional part common to two transducers of different types and each transmitting in a desired band.

This approach is to be distinguished from that of the document U.S. Pat. No. 4,373,143, in which it is used a transducer of low-frequency Tonpilz type, whose horn serves as a countermass for a high-frequency Tonpilz antenna, hence with two transducers of the same type. Moreover, in this same document, the two transmitters are excited simultaneously to produce a non-linear transmission of the parametric type. It is also to be distinguished from the document U.S. Pat. No. 6,690,621, in which a Tonpilz transducer covering the low frequency is juxtaposed to an active annular ceramic covering the high frequency, the latter forming the annular casing of the system.

The invention considered herein consists in the functional combination of two transducers of different types: the Tonpilz and the FFR ("Free Flooded Ring").

The present invention hence proposes to combine a Tonpilz transducer and an FFR transducer to cover a two-octave band, the Tonpilz covering the low-frequency octave (LF) and the FFR, the high-frequency octave (HF), the latter being placed forward in the direction of the transmissions. Moreover, one element of each transducer is made functionally common and it is the reflective "plug" of the FFR transducer, which is also the Tonpilz horn (and the reverse), in order to avoid in particular two problems resulting from a simple association of transducers. Namely, on the one hand, the transducer placed forward on the axis of transmission masks the transducer placed rearward and, on the other hand, the rearward transmission of the transducer placed forward reflects onto the transmitting surface of the transducer placed rearward (plug for the FFR, horn of the Tonpilz), this reflection being liable to interfere destructively with the direct/forward wave transmitted by the transducer placed forward.

Thanks to this implementation of a common element between the two transducers of different types, the Tonpilz no longer has a part masking its radiation along the axis and the wave transmitted rearward by the FFR is baffled by the Tonpilz stack and is unable to be reflected. Such a configuration has another advantage in the case where the two frequency sub-bands are adjacent to each other and where the Tonpilz covers the low band. Indeed, the cavity resonance of the FFR may be excited by the Tonpilz transmission and hence increase the sensitivity to the Tonpilz transmission in the upper part of the its band.

Moreover, if it is desired to further increase the utilizable frequency bands, additional means may be implemented. Indeed, an FFR naturally covers a one-octave band, by coupling between the cavity resonances and the radial mode of the ceramic. On the other hand, a Tonpilz naturally covers, in the best case, half an octave. It is hence useful to broaden the Tonpilz band by coupling the mass-spring mode of the Tonpilz with other modes. For the upper part of the band, the cavity mode of the FFR that is combined thereto may be used. In the lower part of the band, the proposed solution consists in integrating a cylindrical acoustic baffle about the Tonpilz transducer and in particular about its ring stack and/or about the element put in common, i.e. the horn serving as a "plug", and hence generating a radial cavity mode in a similar way to what is obtained in a structure of the Janus-Helmholtz type (cf. U.S. Pat. No. 5,579,287) and whose frequency is adjusted to the lower part of the low-frequency band. It is hence possible to cover one octave with such a solution of the type: baffled Tonpilz combined with an FFR. It is to be finally noted that this baffle, which must be massive and be the less elastic possible, may fulfil other functions, as for example serving as a protection or a support for a protection cage for the complete transducer.

It may finally be noted that the broadband underwater acoustic transceiver system of the invention has a hemispheric directivity.

Hence, the present invention relates to a broadband underwater acoustic transceiver device including at least one transducer of the Tonpilz type and a transducer of the FFR ("Free Flooded Ring") type,

- the Tonpilz-type transducer, cylindrical in shape, being symmetrical in revolution about an anteroposterior axis, said Tonpilz-type transducer including elements arranged from the rear to the front along its anteroposterior axis of revolution, said elements being at least: a rear countermass, electroactive elements and a front horn,
- the FFR-type transducer being symmetrical in revolution about an anteroposterior axis, said FFR-type transducer including elements arranged from the rear to the front along its anteroposterior axis of revolution, said elements being at least: a "plug" and an electroactive ring.

According to the invention, the Tonpilz-type and FFR-type transducers are aligned with each other, their anteroposterior axes of revolution being superimposed, the Tonpilz-type transducer being placed rearward and the FFR-type transducer being placed forward and having their respective front transmission directions oriented forward, and the transducers are combined within the device by putting in common one of their elements, said common element, called the plug-horn element, being the "plug" of the FFR and the horn of the Tonpilz.

In various embodiments of the invention, the following means, which can be used alone or according to any technically possible combinations, are used:

- the electroactive elements of the Tonpilz-type transducer are covered with a layer of a protective composition,
- the electroactive ring of the FFR-type transducer is covered with a layer of a protective composition,
- the protective composition layer is resinated or vulcanized and is typically based on polyurethane, chlorosulfonated polyethylene or nitrile,
- at least one pre-stressing rod is anteroposteriorly extended between the rear countermass and the common plug-horn element,
- said at least one pre-stressing rod is clamped so that the electroactive elements taken in sandwich between the rear countermass and the plug-horn element are constrained in clamped position between these latter,
- the Tonpilz-type transducer includes hollow electroactive elements in the shape of collars or rings or pierced discs, and the pre-stressing rod is central/axial,
- the Tonpilz-type transducer includes hollow electroactive elements in the shape of collars or rings, and the device includes a set of pre-stressing rods, the pre-stressing rods being external to the electroactive elements,
- the Tonpilz-type transducer includes hollow electroactive elements in the shape of collars or rings, and the device includes a set of pre-stressing rods, one of the pre-stressing rods being central/axial and the other pre-stressing rods being external to the electroactive elements,
- the device includes a single pre-stressing rod, said pre-stressing rod being carried by the anteroposterior axis of revolution of the Tonpilz-type transducer,
- the electroactive elements of the Tonpilz-type transducer are solid and the device includes a set of pre-stressing rods, the pre-stressing rods being external to the electroactive elements,
- the common plug-horn element serves as a support for the electroactive ring of the FFR transducer through elastomeric suspensions,
- the common plug-horn element is solid,
- the common plug-horn element is hollow,
- the common plug-horn element is openwork,
- the common plug-horn element is a cylinder,
- the common plug-horn element is a cone,
- the common plug-horn element is flat,
- the common plug-horn element is shaped,
- the common plug-horn element is hemispheric,
- the common plug-horn element is smooth surface,
- the common plug-horn element is grooved,
- the common plug-horn element is structured, in particular on the surface located on the FFR-type transducer side,
- the common plug-horn element is made of metal, in particular steel, aluminium or magnesium in an alloy,
- the common plug-horn element is a composite, in particular based on glass or carbon,
- the common plug-horn element may be bi-material,
- the bi-material common plug-horn element includes an epoxy core and a metallic perimeter,
- the common plug-horn element is adjusted to make a fluttering mode,
- the common plug-horn element includes at least one non-through orifice for the fixation of a pre-stressing rod end,
- the non-through orifice is tapped for the fixation of a threaded pre-stressing rod,
- an annular cavity containing a fluid is arranged against the lateral periphery of the Tonpilz-type transducer, at least against the electroactive elements,
- a guard ring consisted of a rigid metallic mass is arranged at the lateral periphery of the device, at least opposite the Tonpilz-type transducer,
- the guard ring forms a rigid baffle,
- the guard ring is separated from the electroactive elements of the Tonpilz-type transducer by a layer of material,
- the guard ring is separated from the electroactive elements of the Tonpilz-type transducer by the annular cavity, the guard ring is separated from the electroactive elements of the Tonpilz-type transducer by the annular cavity and at least one layer of material, the guard ring is externally covered, at the periphery of the device, by a layer of material, the guard ring and the rear countermass are a single and same element, the guard ring and the rear countermass are distinct elements, the guard ring and the rear countermass are separated by a layer of acoustic damping material, the layer of acoustic damping material is an elastomer or an open-cell or closed-cell foam, the electroactive ring of the FFR-type transducer is applied against the common plug-horn element, the electroactive ring of the FFR-type transducer is coated at least in part with a protective material, the electroactive ring of the FFR-type transducer being applied against the common plug-horn element through a layer of protective material and the front end of the electroactive ring of the FFR-type transducer is closed and a fluid is placed inside said electroactive ring of the FFR-type transducer, said fluid coming into contact with the common plug-horn element, the fluid of the annular cavity is chosen among: a gas, a gaseous composition, a liquid, a gel, the fluid placed inside the electroactive ring of the FFR-type transducer is chosen among: a gas, a gaseous composition, a liquid, a gel, the liquid is an acoustic impedance matching liquid chosen among: castor oil, isoparaffins (in particular Isopar®), silicone oil, perfluorocarbon . . .

the device is covered with a sealing membrane providing a hydrostatic compensation, the material constituting the protective material is the same as that of the sealing membrane, the electroactive elements of the Tonpilz-type transducer and of the FFR-type transducer are piezoelectric ceramics.

DETAILED DESCRIPTION OF AN EXEMPLARY EMBODIMENT

The following description in relation with the appended drawings, given by way of non-limitative example, will allow a good understanding of what the invention consists in and of how it can be implemented.

Figure 1:
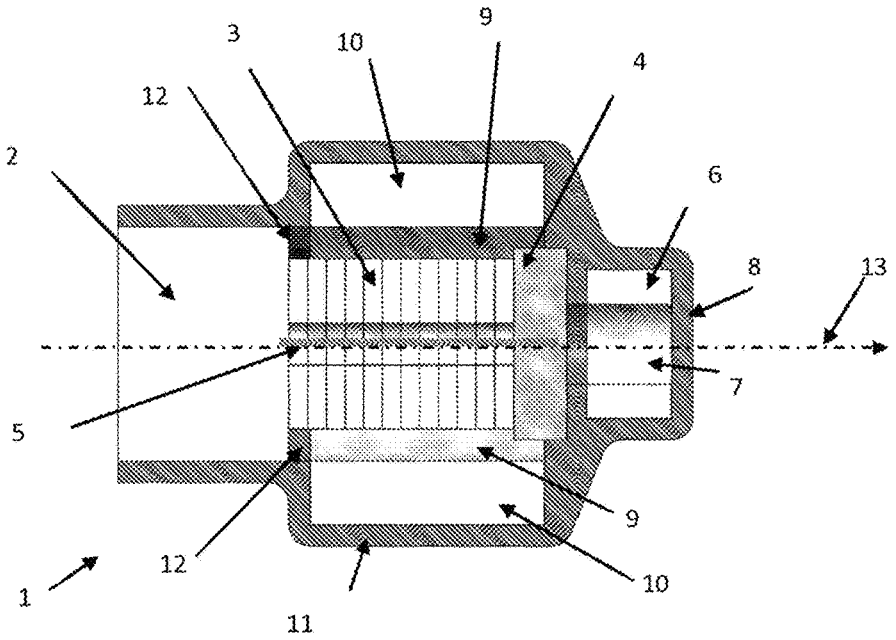
FIG. 1 shows a sectional view of a device according to the invention.

The sectional view of FIG. 1 passes through the revolution symmetry axis of the underwater acoustic transceiver device 1, axis that corresponds to the front axes of forward transmission of each of both Tonpilz and FFR transducers or, in other words, that carries these axes. The Tonpilz-type transducer 2, 3, 4, 5 is on the left in FIG. 1 and, also, on the rear of the device, considering the front transmission direction 13 of the device that is oriented toward the right in FIG. 1. The FFR-type transducer 4, 6 is on the right in FIG. 1 and, also, on the front of the device.

The Tonpilz-type transducer includes, from the rear to the front of the device, a rear countermass 2, a stack of piezoelectric discs, and more particularly herein of piezoelectric rings 3, so that a pre-stressing rod 5 can pass in the centre of the stack, and a horn that is the common plug-horn element 4. The pre-stressing rod 5 is tensioned between the rear countermass 2 and the common plug-horn element 4 in order to apply a constraint to the stack of rings 3.

The FFR-type transducer includes, from the rear to the front of the device, the common plug-horn element 4 and a piezoelectric ring 6. The central part of the piezoelectric ring 6 is closed on the front by a front wall 8 and on the rear by the common plug-horn element 4 and forms a closed central cavity. A fluid 7, for example a liquid that is castor oil, is placed in this central part/cavity of the piezoelectric ring 6. The fluid hence come into contact with the common plug-horn element 4. In the embodiment shown in FIG. 1, the piezoelectric ring 6 is not directly applied to the common plug-horn element 4 and a layer of material is interposed between both. In a particular embodiment, the plug-horn serves as a support for the electroactive ring of the FFR transducer through elastomeric suspensions. In FIG. 1, this is the sealing membrane 11 that also serves as a suspension between both 4, 6.

This combination of two Tonpilz and FFR transducers has another advantage in the case where the two frequency sub-bands of each transducer are adjacent and where the Tonpilz covers the low band. Indeed, the cavity resonance of the FFR may be excited by the Tonpilz transmission and hence increase the sensitivity to the Tonpilz transmission in the upper part of the its band.

Generally, the Tonpilz-type transducer may be either resinated, or inserted into a casing filled with a fluid whose acoustic properties are adapted to the searched operation mode: for example, castor oil for the acoustic transparency or air for a baffling. It is to be noted that, in the case where air is used for the baffling, the baffle includes a rigid casing that encloses the air cavity and the transducer is then generally limited to less deep immersions.

In the device shown in FIG. 1, at the lateral periphery of the Tonpilz-type transducer, is arranged a lateral cavity 9 containing a fluid, for example a liquid that is castor oil. This lateral cavity 9 is annular due to the fact that the Tonpilz-type transducer is substantially cylindrical, just as the other transducer, the FFR one. The lateral cavity 9 extends opposite or against at least a part of the stack of rings 3. In the example shown in FIG. 1, this cavity goes up to a lateral part of the common plug-horn element 4 and does not come into contact with the rear countermass 2, a layer 12 of material being arranged between both 9, 2.

In an alternative embodiment, the fluid is air or a gas or a gaseous composition, in order to obtain a baffling effect. The pressure of the gaseous fluid will be adapted to the needs.

In order to further improve the width of the utilizable frequency band, a guard ring 10 has been placed at the periphery of the device, opposite the Tonpilz-type transducer. In this example, the guard ring 10 is distinct from the rear countermass 2 and is separated therefrom by a layer of material having elasticity properties, typically an elasticity module <100 MPa or, in a variant, by a fluid vent. Herein, this is the sealing membrane 11, which also covers the device, that forms the separation.

Figure 2:
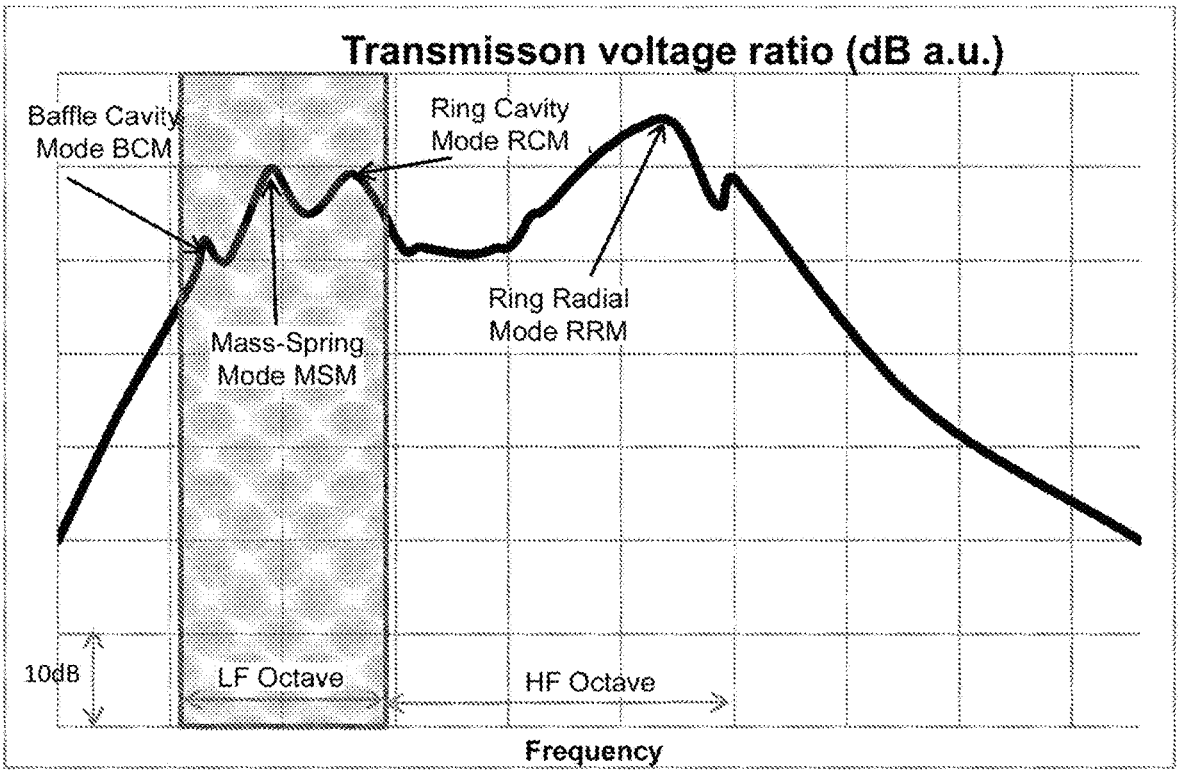
FIG. 2 shows the transmission-response curve of said device.

In FIG. 2, the frequency-response curve, for the transmission, allows visualizing the effects of each type of transducer and the contribution of the common plug-horn element implementation. A baffle-based device has been analysed to produce this curve. The lowest frequencies are on the left along the frequency abscissa axis. The graduation pitch of the ordinates is 10 dB. The represented curve corresponds to the transmission ratio with respect to the voltage applied, in dB as an arbitrary unit.

The action of the Tonpilz-type transducer is visible in the "LF Octave" part, with mainly the mass-spring mode MSM. It can be observed a rising of the curve towards the lowest frequencies thanks to the implementation of the baffling that creates a baffle cavity mode BCM.

The action of the FFR-type transducer is visible in the "HF Octave" part, with mainly a ring radial mode RRM, and, lower in frequency, a ring cavity mode RCM that allows broadening the low-frequency response.

In the preferred using mode of the device, as a function of the low or high frequencies that it is desired to produce, only one of the two transducers is supplied with an alternative current of frequency(ies) in relation with that(those) which it is desired to produce. If desired, the generated waves are generated discontinuously in order to allow a reception between the transmissions. The alternative current may have a wave shape other than sinusoidal and in particular any shape that is useful for generating pure waves and/or with harmonics and/or other linear or non-linear effects. It is however contemplated the case where the two transducers are supplied in the same time by alternative currents adapted to each one.

It is understood that the invention may be implemented in many other ways. For example, the guard ring 10 may be omitted or a single-piece element forming both the rear countermass 2 and the guard ring 10 may be implemented. Moreover, the discs or rings 3 of the Tonpilz-type transducer and/or the piezoelectric ring 6 may be made in various known manners, in particular as single-piece or composite transduction elements, in the latter case by assembly of elementary transducers forming a disc or a ring.

The invention claimed is:

1. A broadband underwater acoustic transceiver device comprising:

at least one Tonpilz transducer and a Free Flooded Ring transducer, wherein the at least one Tonpilz transducer is cylindrical in shape, and is symmetrical in revolution about an anteroposterior axis of revolution extended between a front side and a rear side of the at least one Tonpilz transducer, said at least one Tonpilz transducer including elements arranged from the rear side to the front side along the anteroposterior axis of revolution, said elements being at least: a rear countermass, electroactive elements and a front horn, said at least one Tonpilz transducer having a front transmission direction, wherein the Free Flooded Ring transducer is symmetrical in revolution about an anteroposterior axis of revolution extended between a front side and a rear side of the Free Flooded Ring transducer, said Free Flooded Ring transducer including elements arranged from the rear side to the front side along the anteroposterior axis of revolution of the Free Flooded Ring transducer, said elements being at least: a plug and an electroactive ring, said Free Flooded Ring transducer having a front transmission direction, wherein the at least one Tonpilz transducer and the Free Flooded Ring transducer are aligned with each other, the respective anteroposterior axes of revolution being superimposed, with the at least one Tonpilz transducer being arranged rearward of the Free Flooded Ring transducer and the Free Flooded Ring transducer being arranged forward of the at least one Tonpilz transducer and having respective front transmission directions oriented forward, and wherein the at least one Tonpilz-type transducer and the Free Flooded Ring transducer are combined within the device by the front horn of the at least one Tonpilz transducer being the plug of the Free Flooded Ring transducer, the front horn of the at least one Tonpilz transducer and the plug of the Free Flooded Ring transducer being a common element of the Free Flooded Ring transducer and the at least one Tonpilz transducer.

2. The underwater acoustic transceiver device according to claim 1, wherein at least one pre-stressed rod is antero-posteriorly extended between the rear countermass and the plug-horn element.

3. The underwater acoustic transceiver device according to claim 1, wherein the plug-horn element serves as a support for the electroactive ring of the Free Flooded Ring transducer through elastomeric suspensions.

4. The underwater acoustic transceiver device according to claim 1, wherein an annular cavity containing a fluid is arranged against a lateral periphery of the at least one Tonpilz transducer, at least against the electroactive elements of the at least one Tonpilz transducer.

5. The underwater acoustic transceiver device according to claim 4, wherein the fluid of the annular cavity is chosen among: a gas, a gaseous composition, a liquid, and a gel.

6. The underwater acoustic transceiver device according to claim 1, wherein a guard ring comprising a rigid metallic mass is arranged at a lateral periphery of the device, at least opposite the at least one Tonpilz transducer.

7. The underwater acoustic transceiver device according to claim 6, wherein the guard ring and the rear countermass are distinct elements.

8. The underwater acoustic transceiver device according to claim 7, wherein the guard ring and the rear countermass are separated by a layer of acoustic damping material.

9. The underwater acoustic transceiver device according to claim 1, wherein the electroactive ring of the Free Flooded Ring transducer is coated at least in part with a protective material, the electroactive ring of the Free Flooded Ring transducer being applied against the plug-horn element through a layer of protective material and wherein the front side of the electroactive ring of the Free Flooded Ring transducer is closed and a fluid is placed inside said electroactive ring of the Free Flooded Ring transducer, said fluid coming into contact with the plug-horn element.

10. The underwater acoustic transceiver device according to claim 9, wherein the fluid placed inside the electroactive ring of the Free Flooded Ring transducer is chosen among: a gas, a gaseous composition, a liquid, and a gel.

11. The underwater acoustic transceiver device according to claim 1, wherein the electroactive elements of the at least one Tonpilz transducer and the electroactive ring of the Free Flooded Ring transducer are piezoelectric ceramics.

* * * * *